US008368724B2

(12) United States Patent
Oh

(10) Patent No.: US 8,368,724 B2
(45) Date of Patent: Feb. 5, 2013

(54) DISPLAY APPARATUS AND CONTROL METHOD THEREOF FOR SAVING POWER

(75) Inventor: Jang-Geun Oh, Suwon-si (KR)

(73) Assignee: LG Electronics Inc., Seoul (KR)

( * ) Notice: Subject to any disclaimer, the term of this patent is extended or adjusted under 35 U.S.C. 154(b) by 1174 days.

(21) Appl. No.: 12/212,347

(22) Filed: Sep. 17, 2008

(65) Prior Publication Data

US 2009/0109246 A1 Apr. 30, 2009

(30) Foreign Application Priority Data

Oct. 26, 2007 (KR) ..... 10-2007-0108465

(51) Int. Cl.
*G09G 5/10* (2006.01)

(52) U.S. Cl. ..... 345/690; 345/211; 340/815.55

(58) Field of Classification Search ..... 345/102, 345/211

See application file for complete search history.

(56) References Cited

U.S. PATENT DOCUMENTS 6,864,665 B2 * 3/2005 Yoshida ..... 320/132
7,154,468 B2 12/2006 Linzmeier et al.
2005/0110740 A1 * 5/2005 Linzmeier et al. ..... 345/102

FOREIGN PATENT DOCUMENTS

CN 1886777 A 12/2006

* cited by examiner

*Primary Examiner* — Sumati Lefkowitz
*Assistant Examiner* — Jesus Hernandez
(74) *Attorney, Agent, or Firm* — Birch, Stewart, Kolasch & Birch, LLP

(57) ABSTRACT

A display apparatus and a control method thereof, wherein output of a backlight is reduced depending on the remaining amount of a battery or a pixel of an input image, and a brightness value of an output image is increased to compensate for the reduced output of the backlight. A display apparatus according to the present invention includes a display controller for controlling brightness of an image displayed on a display panel and output of a backlight of the display panel; and a control unit for detecting the remaining amount of a battery and controlling the display controller in accordance with the remaining amount of the battery. The control unit includes an operation unit for calculating an output value of the backlight and a pixel brightness correction value of the output image.

9 Claims, 6 Drawing Sheets

| | Remaining amount of battery | | | |
|---|---|---|---|---|
| | 60% or more | 60 to 40% | 40 to 30% | 30% or less |
| | 0 | 40 | 84 | 127 |
| Backlight output | 100% | 84% | 66% | 50% |

DISPLAY APPARATUS AND CONTROL METHOD THEREOF FOR SAVING POWER

CROSS REFERENCE TO RELATED APPLICATIONS

The present application is related to, and claims priority to, Korean patent application 10-2007-0108465, filed on Oct. 26, 2007, the entire contents of which are hereby incorporated by reference.

BACKGROUND OF THE INVENTION

1. Field of the Invention

The present invention relates to a display apparatus and a control method thereof, and more particularly, to a display apparatus and a control method thereof, wherein brightness of an output image is increased depending on the remaining amount of a battery or brightness of an input image, and output of a backlight is decreased in correspondence with the brightness of the output image, so that power consumption of the backlight can be reduced while maintaining the brightness of the image.

2. Description of the Related Art

Recently, computer driven programs are provided with a function of increasing brightness of an output image using a gamma correction method and adjusting output of a backlight in correspondence with the brightness.

The gamma correction method is a method of adjusting overall brightness values by setting a brightness function having a gamma value as an index and changing the gamma value.

In the gamma correction method, the brightness function is generally expressed as shown in mathematical expression 1.

$$X=[(X/\text{maximum brightness value})\hat{}\,\gamma]*\text{maximum brightness value} \quad (1)$$

Thus, since the brightness function has variable "γ" as an index, a brightness value is not corrected by the gamma correction method if brightness of an input image is the same as maximum brightness or has a value of "0".

In the gamma correction method, an optimum gamma (γ) value suitable for an image should be obtained. However, a process of calculating the optimum gamma value automatically is complicated. In addition, if users themselves determine the optimum gamma value while viewing an output image, its accuracy will be different depending on each individual.

Therefore, the related art described above has following problems.

If brightness of an output image is increased using the gamma correction method, a pixel whose original input brightness has a maximum or minimum brightness value cannot be compensated for decrease in brightness, which is caused by the decrease in the output of backlight. Therefore, boundaries between adjacent pixels are unclear and thus the outline of the image is obscured, whereby the image is degraded.

Further, it is difficult to rapidly detect and apply a gamma value depending on the remaining amount of a battery.

SUMMARY OF THE INVENTION

The present invention is conceived to solve the aforementioned problems in the prior art. An object of the present invention is to provide a display apparatus and a control method thereof, wherein degradation of an output image can be prevented by reducing output of a backlight while uniformly compensating the entire image.

According to an aspect of the present invention, there is provided a display apparatus, which includes: a display controller for controlling brightness of an image displayed on a display panel and output of a backlight of the display panel; and a control unit for detecting the remaining amount of a battery and controlling the display controller in accordance with the remaining amount of the battery, wherein the control unit includes an operation unit for calculating an output value of the backlight and a pixel brightness correction value of the output image.

At this time, the control unit further includes a detector for detecting pixel brightness of the image, and the operation unit calculates the output value of the backlight and the pixel brightness correction value using the pixel brightness detected by the detector.

Further, the operation unit may calculate a brightness limit value ($BR_{lim}$) and the output value of the backlight ($OP_{out}$) in accordance with the remaining amount of the battery, and calculate the pixel brightness correction value ($BR_{out}$) in accordance with the brightness limit value.

Here, the brightness limit value may be set to a value with which decrease in the brightness of the image is compensated in accordance with decrease in the output value of the backlight.

Further, the output value of the backlight may be determined in proportion to the remaining amount of the battery, the brightness limit value may be determined in inverse proportion to the output value of the backlight, and the pixel brightness correction value may be determined in proportion to the brightness limit value.

Further, $BR_{lim}=I_1*[(BA_{max}-BA_{min})/(BA_{rem}-BA_{min})]*(BR_{max}-BR_{limmax})+J_1*BR_{min}+K_1$, $OP_{out}=I_2*[(BA_{rem}-BA_{min})/(BA_{max}-BA_{min})]*(OP_{max}-OP_{min})+J_2*OP_{min}+K_2$, and $BR_{out}=I_3*[(BR_{max}-BR_{lim})/BR_{max}]*BR_{in}+BR_{lim}+K_3$, where $BR_{lim}$ is a brightness limit value, $BA_{rem}$ is the remaining amount of the battery, $BA_{min}$ is a minimum capacity of the battery, $BA_{max}$ is a maximum capacity of the battery, $BR_{max}$ is a maximum brightness value, $BR_{limmax}$ is a maximum brightness limit value, $BR_{min}$ is a minimum brightness value, $OP_{out}$ is an output value of the backlight, $OP_{max}$ is a maximum output value, $BR_{out}$ is a pixel brightness correction value, $BR_{in}$ is an input brightness value, and $I_1$, $I_2$, $I_3$, $J_1$, $J_2$, $K_1$, $K_2$ and $K_3$ are correction coefficients.

Meanwhile, the display apparatus may farther include a storage unit for storing the brightness upper limit value and the output value of the backlight in accordance with the remaining amount of the battery, wherein the operation unit may calculate the brightness upper limit value and the output value of the backlight by reading a lookup table stored in the storage unit.

Further, the operation unit may calculate the output value of the backlight and the pixel brightness correction value using pixel brightness maximum value ($BR_{hig}$) detected by the detector.

Further, the output value of the backlight may be in proportion to the pixel brightness maximum value, and the pixel brightness correction value may be in inverse proportion to the pixel brightness maximum value.

Further, the output value of the backlight may be set as much as to offset increase in brightness of the image, the brightness of the image being increased when the pixel brightness maximum value is changed to a maximum brightness value.

Further, the pixel brightness maximum value may be calculated from an average brightness of images outputted for a specified period of time.

Further, $OP_{out}=OP_{max}-I_4*[(BR_{max}-BR_{hig})/BR_{max}]*OP_{max}+K_4$, and $BR_{out}=BR_{in}+(BR_{max}-BR_{hig})+K_5$, where $OP_{out}$ is an output value of the backlight, $OP_{max}$ is a maximum output value, $BR_{max}$ is a maximum brightness value, $BR_{hig}$ is a pixel brightness maximum value, $BR_{out}$ is a pixel brightness correction value, $BR_{in}$ is an input brightness value, and $I_4$, $K_4$ and $K_5$ are correction coefficients.

According to another aspect of the present invention, there is provided a display control method for saving power, including the steps of: (A) measuring the remaining amount of a battery; (B) calculating an output value of a backlight and a pixel brightness correction value of an output image using the remaining amount of the battery; and (C) changing display setting using the calculated output value of the backlight and pixel brightness correction value, thereby displaying an image.

At this time, steps (A) to (C) may be performed only when the remaining amount of the battery is below a predetermined value.

Further, step (B) may include the steps of: (B1) calculating the output value of the backlight using the remaining amount of the battery; (B2) calculating a pixel brightness limit value using the remaining amount of the battery; and (B3) calculating the pixel brightness correction value using the pixel brightness limit value.

Further, in steps (B1) and (B2), the output value of the backlight and the pixel brightness limit value may be read and calculated from a lookup table.

Further, in step (B3), the pixel brightness correction value may be read and calculated from a lookup table.

According to a further aspect of the present invention, there is provided a display control method for saving power, including the steps of: (A) detecting a maximum brightness value of an input image; (B) calculating an output value of backlight using the maximum brightness value; (C) calculating a pixel brightness correction value using the maximum brightness value; and (D) changing display setting using the calculated output value of the backlight and the pixel brightness correction value.

At this time, steps (A) to (D) may be performed only when the remaining amount of the battery is below a predetermined value.

As described above, in a display apparatus and a control method thereof according to the present invention, the following advantages can be expected.

In an embodiment of the present invention, power consumption of a backlight can be reduced while all pixels of an input image are compensated for increase in brightness. Accordingly, since contrast between pixels is uniformly maintained while reducing power consumption, the present invention is advantageous in that degradation of an output image can be prevented.

Further, in another embodiment of the present invention, since brightness is increased without changing contrast between changed and outputted pixels, power consumption can be reduced while minimizing deformation of an original image.

DETAILED DESCRIPTION OF THE INVENTION

Hereinafter, a display apparatus and a control method thereof according to embodiments of the present invention will be described in detail with reference to the accompanying drawings.

Figure 1:
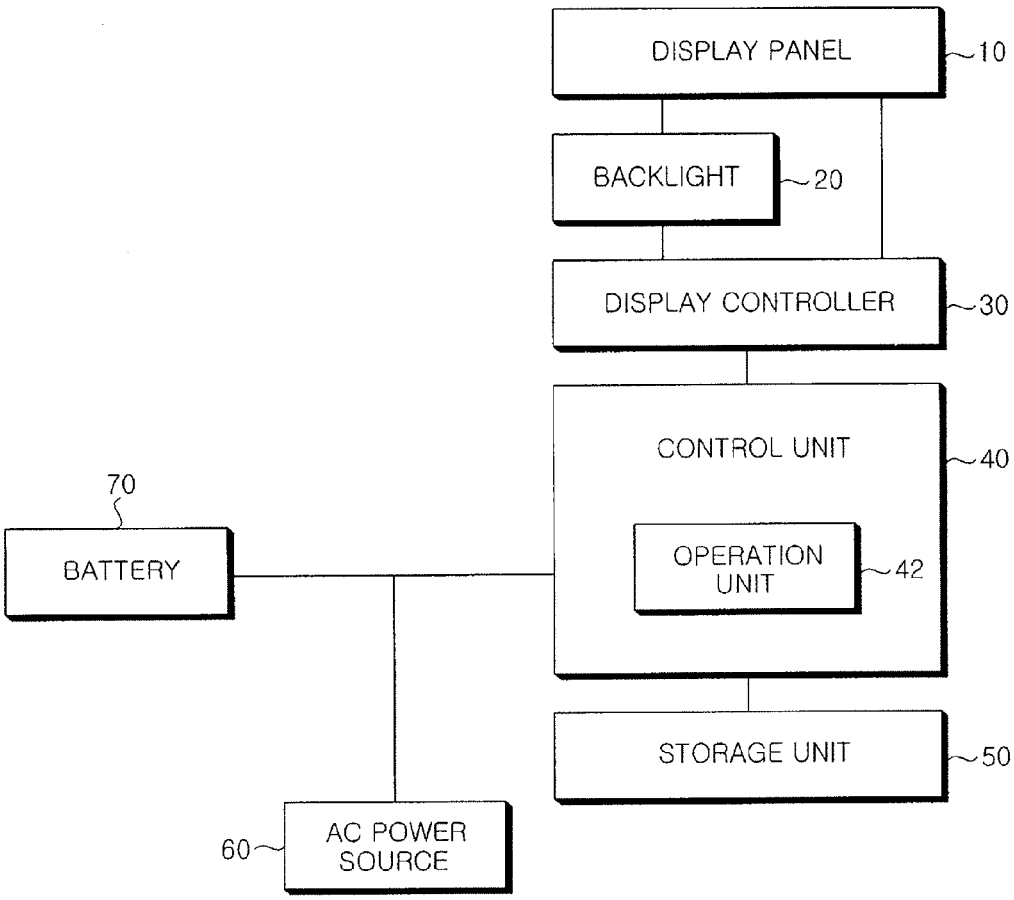
FIG. 1 is a block diagram showing a display apparatus according to a specific embodiment of the present invention.
Figures 2, 3:
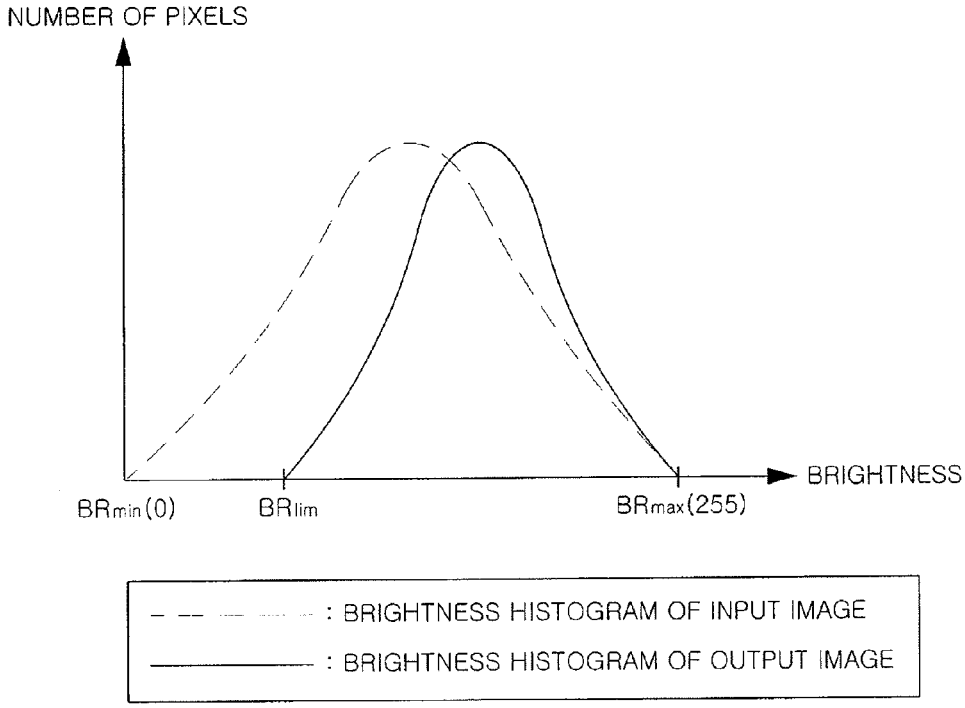
FIG. 2 is a graph showing an example of brightness histograms of input and output images in the specific embodiment of the present invention.
FIG. 3 is a table showing an example of a lookup table applied to the specific embodiment of the present invention.

FIG. 1 is a block diagram showing a display apparatus according to a specific embodiment of the present invention, FIG. 2 is a graph showing an example of brightness histograms of input and output images in the specific embodiment of the present invention, and FIG. 3 is a table showing an example of a lookup table applied to the specific embodiment of the present invention.

As shown in FIG. 1, the display apparatus according to the specific embodiment of the present invention includes a display panel 10. The display panel 10 is a unit on which images are displayed, and a liquid crystal display (LCD) panel is used as the display panel 10.

The display panel 10 is provided with a backlight 20 for providing light to the display panel 10. The backlight 20 is a light source for providing light to the display panel 10, and a variety of light sources, such as a light source using a light emitting diode (LED) and a light source using a luminescence lamp, may be used as the backlight 20.

Meanwhile, a display controller 30 is connected to the display panel 10 and the backlight 20, and controls an output state of an image outputted to the display panel 10 and an output of the backlight 20. The output state refers to various setup values for display, such as contrast and resolution, including pixel brightness of the display panel 10.

The display controller 30 controls output of the backlight 20 and brightness of an image outputted to the display panel 10 under the control of a control unit 40 that will be described below.

The control unit 40 for controlling the display controller 30 is connected to the display controller 30. The control unit 40 is a unit for decreasing output of the backlight 20 depending on the remaining amount of a battery 70 to reduce power consumption when power is insufficient in which decrease in brightness of an image caused by decrease in the output value of the backlight 20 is compensated by changing a predetermined brightness value.

At this time, embodiments of the present invention will be divided and described depending on methods of calculating a changed brightness value (hereinafter, referred to as a "pixel brightness correction value") performed by the control unit 40.

First, according to the specific embodiment of the present invention, the control unit 40 includes an operation unit 42 for calculating an output value of the backlight 20 changed depending on the remaining amount of the battery 70 (hereinafter, referred to as an "output value of the backlight 20") and setting a minimum brightness value of an output image to a value increased to a certain extent from "0" (hereinafter, referred to as a "brightness limit value") in accordance with the output value of the backlight 20.

The operation unit 42 may set the output value of the backlight 20 to be in proportion to the remaining amount of the battery 70. That is, if the remaining amount of the battery 70 is reduced below a predetermined value, the output value of the backlight 20 may be reduced in proportion to the remaining amount of the battery 70. In this case, if the output value of the backlight 20 is too low, it may be difficult to figure out the image. For this reason, the operation unit 42 may set a lower limit value and lower the output value of the backlight 20 in between the maximum output value and the lower limit value depending on the remaining amount of the battery 70.

Thus, the output value of the backlight 20 is expressed as shown in mathematical expression 2.

$$OP_{out}=I_2*[(BA_{rem}-BA_{min})/(BA_{max}-BA_{min})]*(OP_{max}-OP_{min})+J_2*OP_{min}+K_2 \quad (2)$$

where $OP_{out}$ is an output value of the backlight, $BA_{rem}$ is the currently remaining amount of the battery 70, $BA_{min}$ is a minimum capacity of the battery 70, with which a system enters a power saving mode, $BA_{max}$ is a maximum capacity of the fully charged battery 70, $OP_{max}$ is the maximum output value of the backlight 20, and $OP_{min}$ is a minimum output value of the backlight 20, which is set to minimum to prevent degradation of an image.

In addition, $I_2$, $J_2$ and $K_2$ are correction coefficients determined by experiment. That is, $I_2$, $J_2$ and $K_2$ are proportional constants with which the output of the backlight 20 is decreased at an appropriate rate depending on a decrease in the remaining amount of the battery 70.

The operation unit 42 sets the brightness limit value using the set output value of the backlight 20. As the output value of the backlight 20 is lower, the brightness limit value is set higher. Furthermore, the brightness limit value is set as high as to compensate decrease in brightness of an output image in accordance with decrease in the output value of the backlight 20. That is, a value of brightness increased to compensate the brightness decreased due to decrease in the output value of the backlight 20 is set as the brightness limit value, and the brightness limit value is set as the minimum brightness value.

The brightness limit value may be expressed as shown in mathematical expression 3. At this time, since the output value of the backlight 20 is determined by the remaining amount of the battery 70, the brightness limit value may be expressed by the remaining amount of the battery 70.

$$BR_{lim}=I_1*[(BA_{max}-BA_{min})/(BA_{rem}-BA_{min})]*(BR_{max}-BR_{limmax})+J_1*BR_{min}+K_1 \quad (3)$$

where $BR_{lim}$ is a brightness limit value, $BA_{rem}$ is the remaining amount of the battery 70, $BA_{min}$ is a minimum capacity of the battery 70, $BA_{max}$ is a maximum capacity of the battery 70, $BR_{max}$ is a maximum brightness value, $BR_{limmax}$ is a maximum brightness limit value, and $BR_{min}$ is a minimum brightness value.

At this time, the $BR_{limmax}$ is a maximum brightness limit value, which is set to prevent an image from being degraded when the brightness limit value is set too high.

In addition, $I_1$, $J_1$ and $K_1$ are correction coefficients determined by experiment to precisely compensate the brightness decreased due to the decrease in the output value of the backlight 20.

The operation unit 42 calculates the pixel brightness correction value, which is a corrected brightness value of an output pixel, using the brightness limit value. Correction of the pixel brightness value means that a brightness value of an input pixel having a range between the minimum and maximum brightness values is changed to a brightness value having a range between the brightness limit value and the maximum brightness value (i.e., the brightness of the input pixel is increased as high as the brightness limit value, and then contrast is changed to satisfy the range between the brightness limit value and the maximum brightness value).

This will be described using histograms as shown in FIG. 2. That is, pixels having brightness values indicated by a dotted line are corrected to have brightness values indicated by a solid line.

In a general display apparatus, "0" is the minimum brightness value and "255" is the maximum brightness value.

At this time, the pixel brightness correction value may be calculated as shown in mathematical expression 4.

$$BR_{out}=I_3*[(BR_{max}-BR_{lim})/BR_{max}]*BR_{in}+BR_{lim}+K_3 \quad (4)$$

where $BR_{out}$ is a pixel brightness correction value, $BR_{lim}$ is a brightness limit value, $BR_{max}$ is a maximum brightness value, $BR_{in}$ is an input brightness value, and $I_3$ and $K_3$ are correction coefficients.

As described above, it is shown that the output value of the backlight 20, the brightness limit value and the pixel brightness correction value are calculated by the mathematical expressions. However, the operation unit 42 according to the specific embodiment of the present invention may read the output value of the backlight 20 and the brightness limit value from a lookup table storing the output values of the backlight 20 and the brightness limit values obtained by experiment. The lookup table is useful when the brightness of an image is non-linearly influenced by decrease in the output of the backlight 20.

An example of the lookup table is shown in FIG. 3.

As shown in FIG. 3, the stored output of the backlight is decreased as the remaining amount of the battery 70 is decreased, and the stored brightness limit value is increased as the remaining amount of the battery 70 is decreased. The values presented in the table of FIG. 3 are values determined by experiment on the basis of the aforementioned mathematical expressions.

Although only the brightness limit value and output value of the backlight 20 are stored in the lookup table shown in FIG. 3, the pixel brightness correction value may also be stored in the lookup table.

Meanwhile, in another embodiment of the present invention, the control unit 40 detects a brightness value of an output image and calculates an output value of the backlight 20 and a pixel brightness correction value using the detected brightness value.

Figure 4:
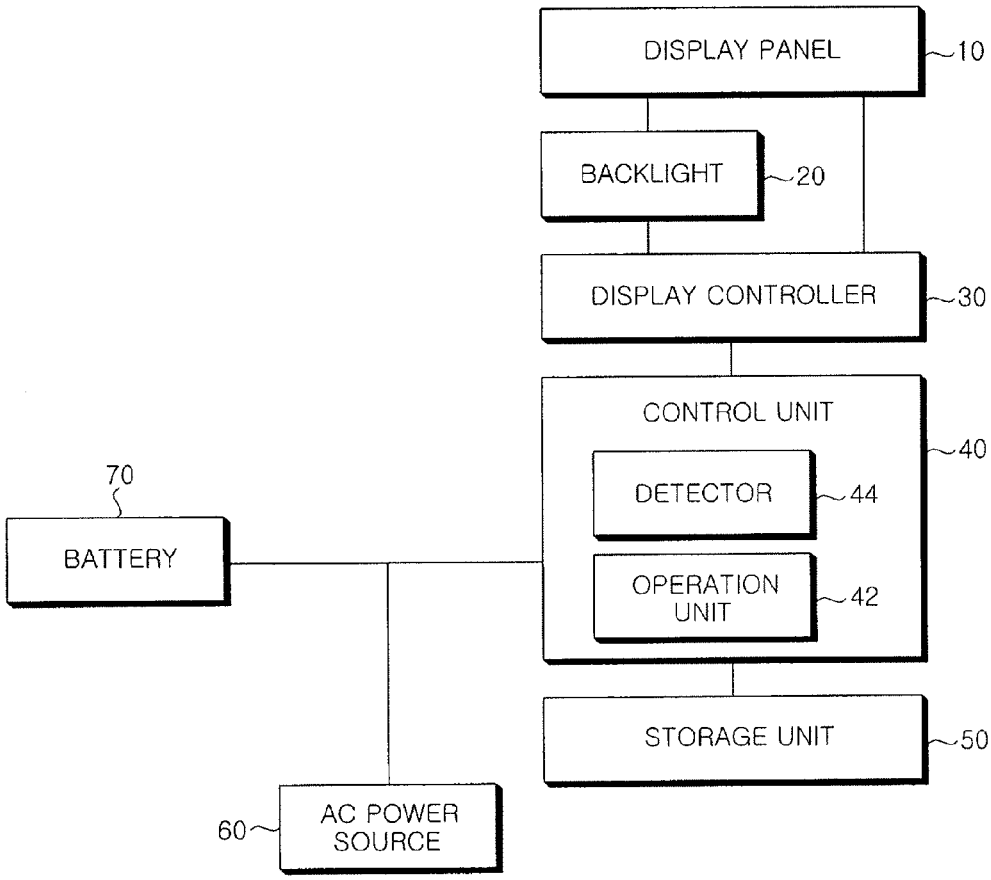
FIG. 4 is a block diagram showing a display apparatus according to another embodiment of the present invention.
Figure 5:
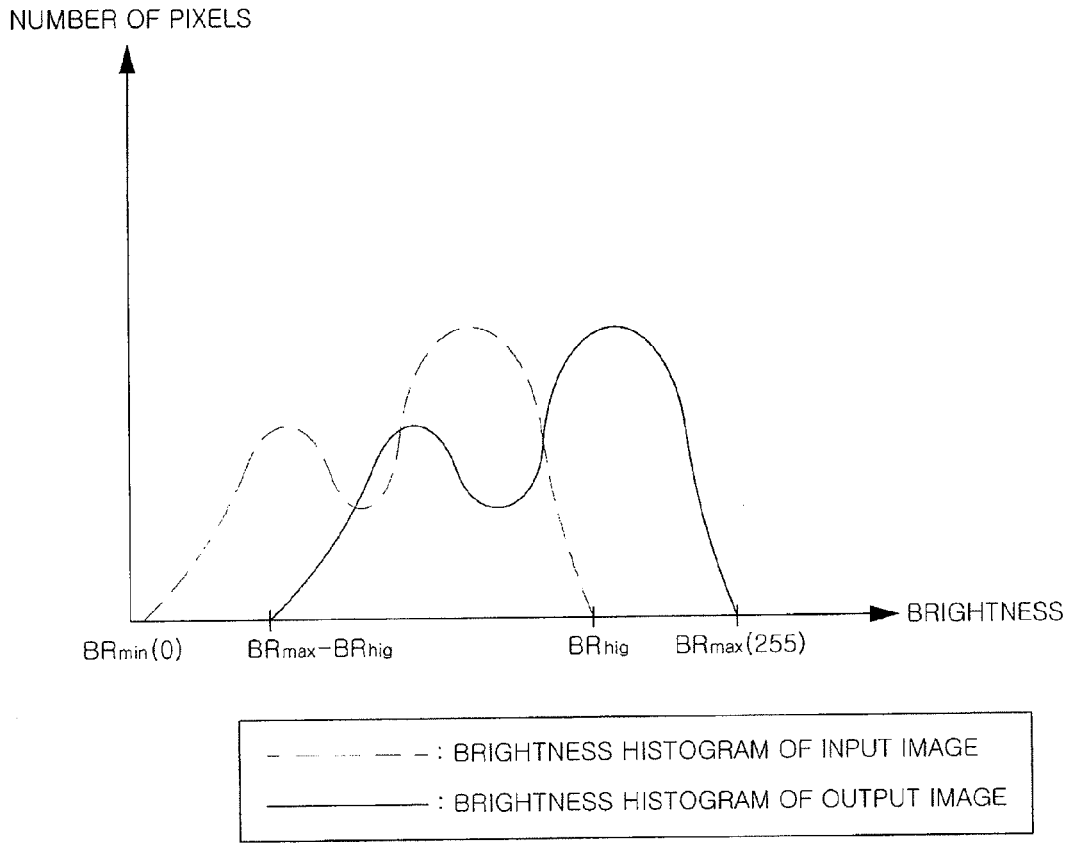
FIG. 5 is a graph showing an example of brightness histograms of input and output images in the other embodiment of the present invention.

FIG. 4 is a block diagram showing a display apparatus according to the other embodiment of the present invention, and FIG. 5 is a graph showing an example of brightness histograms of input and output images in the other embodiment of the present invention.

That is, the control unit 40 detects a brightness value of the brightest pixel (hereinafter, referred to as a "pixel brightness maximum value") among brightness of pixels in an input image and increases brightness of all the pixels by a difference between the pixel brightness maximum value and the maximum brightness value.

To this end, as shown in FIG. 4, the control unit 40 according to the other embodiment of the present invention includes a detector 44 for detecting brightness of pixels in an input image and an operation unit 42 for calculating the pixel brightness correction value using the brightness of the pixels detected by the detector 44 and calculating the output value of the backlight 20 in accordance with the pixel brightness correction value.

That is, as shown in FIG. 5 using histograms, the detector 44 detects the pixel brightness maximum value among the brightness of pixels in an input image indicated by a dotted line, and the operation unit 42 calculates a difference between the maximum brightness value and the pixel brightness maximum value and then increases brightness of each pixel as much as the difference (the input image is converted into an image having a brightness histogram indicated by a solid line shown in FIG. 5). As a result, the output value of the backlight 20 can be reduced as much as the increased brightness of the pixels.

At this time, the detector 44 may detect brightness of the respective pixels forming the input image and then store the detected brightness in a buffer. In this case, the detected brightness is stored in a two-dimensional variable corresponding to the number of pixels.

Furthermore, the pixel brightness maximum value may be calculated for all output images. However, considering effectiveness, the pixel brightness maximum value may be obtained by calculating an average of brightness of pixels for a specific period of time or for the specific number of image frames.

Hereinafter, the pixel brightness maximum value is calculated with respect to one input image frame for convenience of illustration. However, the same configuration and procedure are also applied when an average of brightness of pixels in a plurality of input images is calculated to obtain the pixel brightness maximum value.

The output value of the backlight 20 and the pixel brightness correction value according to the other embodiment of the present invention are expressed as shown in mathematical expressions 5 and 6.

$$OP_{out}=OP_{max}-I_4*[(BR_{max}-BR_{hig})/BR_{max}]*OP_{max}+K_4 \quad (5)$$

where $OP_{out}$ is an output value of the backlight 20, $OP_{max}$ is a maximum output value, $BR_{max}$ is a maximum brightness value, and $BR_{hig}$ is a pixel brightness maximum value.

In addition, $I_4$ and $K_4$ are correction coefficients determines by experiment to correspond a change in the output of the backlight 20 to the increase/decrease in brightness.

$$BR_{out}=BR_{in}+(BR_{max}-BR_{hig})+K_5 \quad (6)$$

where $BR_{out}$ is a pixel brightness correction value, $BR_{in}$ is an input brightness value, $BR_{max}$ is a maximum brightness value, and $BR_{hig}$ is a pixel brightness maximum value.

In addition, $K_5$ is a correction coefficient.

In the other embodiment of the present invention, the output value of the backlight 20 and the pixel brightness correction value may be obtained by reading a lookup table stored in a storage unit 50, instead of using mathematical expressions 5 and 6.

Meanwhile, each of the specific and other embodiments of the present invention includes the battery 70 and the AC power source unit 60 as shown in FIGS. 1 and 4.

The AC power source unit 60 is a unit for receiving power supplied from an AC power source and supplying the power to an electronic device having the display apparatus, and the battery 70 is a unit for supplying power to the electronic device using charged power when the AC source is not supplied.

At this time, since an object of the present invention is to reduce power consumption of the battery 70 and extend a use time of the electronic device, the display apparatus of the present invention may not operate when the AC power source is connected.

Hereinafter, a control method of the display apparatus according to the present invention will be described in detail.

Figure 6:
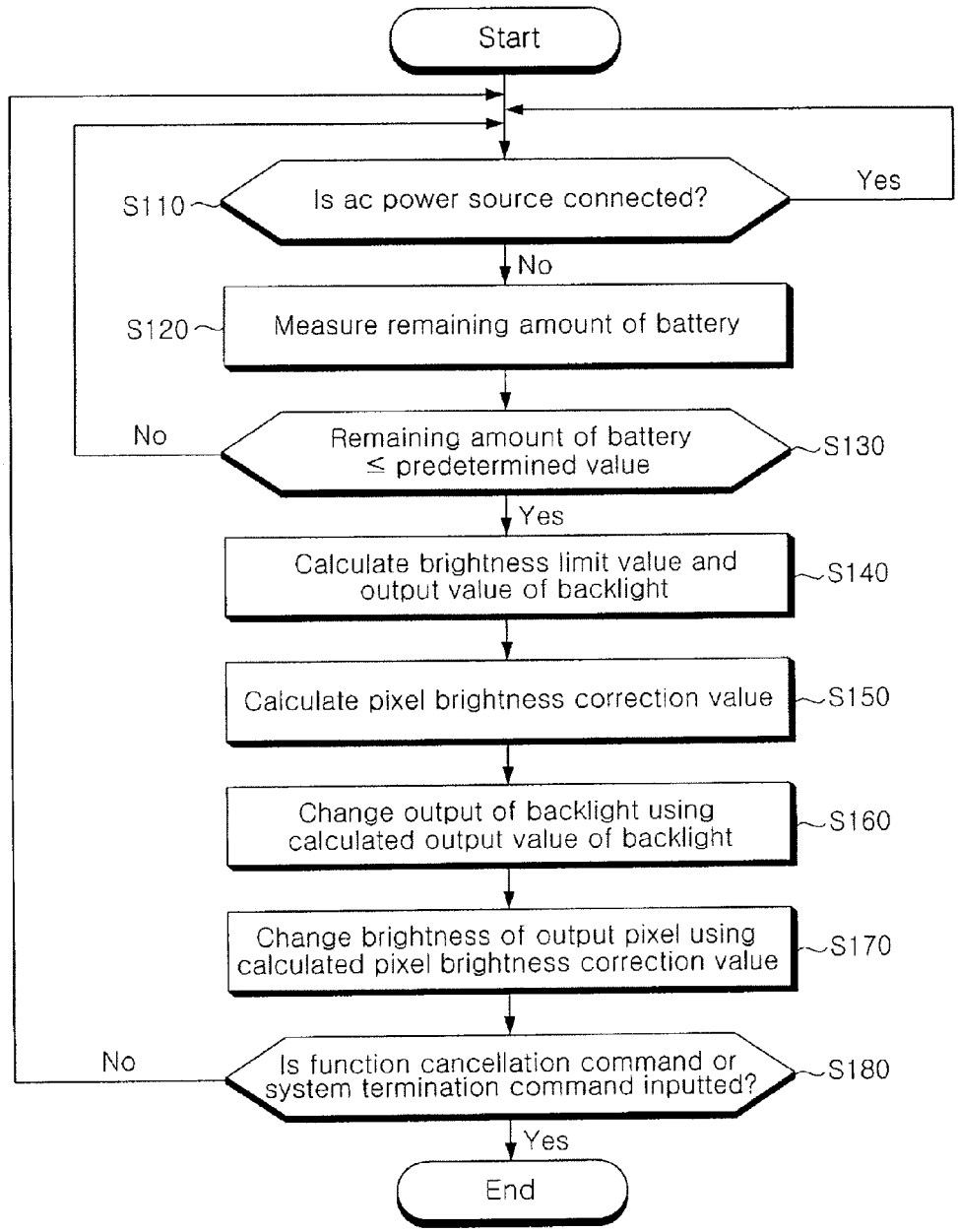
FIG. 6 is a flowchart illustrating a control method of the display apparatus according to the specific embodiment of the present invention.
Figure 7:
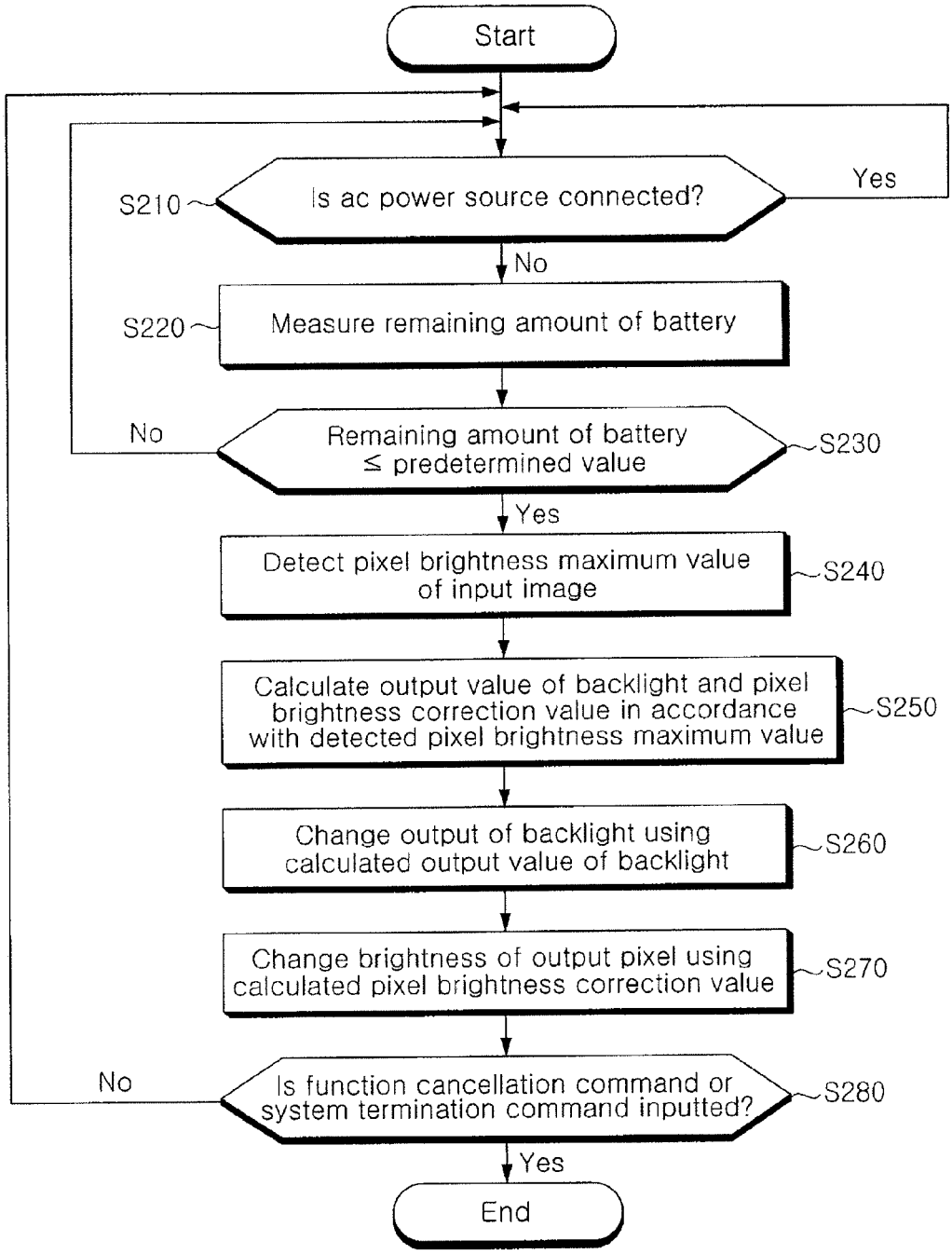
FIG. 7 is a flowchart illustrating a control method of the display apparatus according to the other embodiment of the present invention.

FIG. 6 is a flowchart illustrating a control method of the display apparatus according to the specific embodiment of the present invention, and FIG. 7 is a flowchart illustrating a control method of the display apparatus according to the other embodiment of the present invention.

As shown in FIG. 6, in a control method of the display apparatus according to the specific embodiment of the present invention, the control unit 40 first determines whether or not an AC power source is connected (S110).

This is to allow the display apparatus of the present invention not to operate when an electronic device having the display apparatus of the present invention receives power supplied from the AC power source.

If it is determined at step S110 that the AC power source is not connected, the control unit 40 confirms the remaining amount of the battery (S120). The remaining amount of the battery may be measured by receiving information on the remaining amount of the battery transmitted from a smart battery 70 or by directly measuring voltage or current of the battery 70.

Thereafter, the control unit 40 determines whether or not the remaining amount of the battery 70 is below a predetermined value (S130). When the remaining amount of the battery 70 is sufficient, the present invention is not implemented. When the remaining amount of the battery is insufficient, power consumption of the backlight 20 is reduced, thereby reducing power consumption of the battery 70.

Thus, if it is determined at step S130 that the remaining amount of the battery 70 is below the predetermined value, the operation unit 42 provided in the control unit 40 calculates an output value of the backlight 20 and a brightness limit value using the remaining amount of the battery 70 (S140).

The output value of the backlight 20 and the brightness limit value are calculated as described above.

The operation unit 42 calculates a pixel brightness correction value using the brightness limit value (S150). At this time, the pixel brightness correction value is calculated also as described above.

Thereafter, the control unit 40 changes output of the backlight 20 using the output value of the backlight 20 calculated by the operation unit 42, corrects brightness of each pixel in an image to be outputted using the pixel brightness correction value calculated by the operation unit 42, and then displays the image through the display panel 10 (S160 and S170).

Then, the control unit 40 repeatedly performs steps S110 to S170 until a function cancellation command or a system termination command is transmitted by a user (S180).

In a control method of the display apparatus according to the other embodiment of the present invention, the control unit 40 confirms connection of an AC power source and senses the remaining amount of the battery in the same manner as the specific embodiment of the present invention as shown in FIG. 7, thereby determining execution of the present invention (S210, S220 and S230).

Thereafter, in the other embodiment of the present invention, the detector 44 provided in the control unit 40 detects a maximum brightness value (a pixel brightness maximum value) among brightness of pixels in an input image (S240). At this time, the pixel brightness maximum value may be obtained from an average of respective pixel values in a plurality of frames divided by the unit of time or by the number of output image frames.

For example, if the plurality of frames are divided by the unit of 5 minutes, an average of brightness at pixel (1, 1) outputted for 5 minutes is calculated and then stored in variable (1, 1). In the same method, averages of brightness of respective pixels are stored in a matrix of n by m, and a maximum brightness value is then calculated from the matrix of n by m.

After the detector 44 calculates the pixel brightness maximum value, the operation unit 42 calculates an output value of the backlight 20 and a pixel brightness correction value using the calculated pixel brightness maximum value (S250).

At this time, the output value of the backlight 20 and the pixel brightness correction value are calculated as described above.

The control unit 40 changes output of the backlight 20 and brightness of output pixels using the output value of the backlight 20 and the pixel brightness correction value calculated in the same manner as the specific embodiment of the present invention (S260 and S270).

Thereafter, the control unit 40 repeatedly performs steps S210 to S270 until a function cancellation command or a system termination command is transmitted by a user (S280).

The scope of the present invention is not limited to the embodiments described and illustrated above but is defined by the appended claims. It will be apparent that those skilled in the art can make various modifications and changes thereto within the scope of the invention defined by the claims.

For example, it has been described herein that a brightness maximum value of pixels in an input image is changed into a maximum brightness value supported by a display apparatus using the brightness maximum value. However, when the number of pixels having the brightness maximum value is extremely small and most of the other pixels have a low brightness value, it is possible to ignore the minority pixels having the brightness maximum value, increase brightness values of all pixels, and then adjust brightness of pixels that exceed the maximum brightness value to the maximum brightness.

Quantitatively, an average brightness value of pixels having brightness of top X % is set as the pixel brightness maximum value, and brightness values of the respective pixels are uniformly increased so that the pixel brightness maximum value becomes the maximum brightness value. At this time, output of the backlight is reduced as much as the increased brightness value, thereby reducing power consumption.

In this case, since brightness of some pixels within the top X % needs to be corrected to brightness exceeding the maximum brightness, which is impossible, the brightness of these pixels is set as the maximum brightness.

The reason is to prevent a situation where brightness values of the pixels cannot be increased due to the minority pixels having the brightness maximum value although most of the pixels have low brightness values, even when reducing power consumption is seriously needed.

Since an image is degraded when a value "X" is too large, the value "X" should be set to a proper size by experiment.

What is claimed is:

1. A display apparatus comprising:

a display panel;

a display controller configured to control a brightness of an image displayed on the display panel and to control an output of a backlight of the display panel; and a control unit configured to detect the detect a remaining amount of a battery and to control the display controller in accordance with the remaining amount of the battery, wherein the control unit includes an operation unit configured to calculate an output value of the backlight and a pixel brightness correction value of the image displayed on the display panel, wherein the operation unit is configured to calculate a brightness limit value ($BR_{lim}$) and the output value of the backlight ($OP_{out}$) in accordance with the remaining amount of the battery, and to calculate the pixel brightness correction value ($BR_{out}$) in accordance with the brightness limit value, and wherein the brightness limit value is expressed by:

$$BR_{lim}=I_1*[(BA_{max}-BA_{min})/(BA_{rem}-BA_{min})]*(BR_{max}-BR_{limmax})+J_1*BR_{min}+K_1$$

where $BR_{lim}$ is the brightness limit value, $BA_{rem}$ is the remaining amount of the battery, $BA_{min}$ is the minimum capacity of the battery, $BA_{max}$ is the maximum capacity of the battery, $BR_{max}$ is a maximum brightness value, $BR_{limmax}$ is a maximum brightness limit value, $BR_{min}$ is a minimum brightness value, and $I_1$, $J_1$, and $K_1$ are non-zero correction coefficients.

2. The display apparatus as claimed in claim 1, wherein the control unit is configured to determine the output value of the backlight in proportion to the remaining amount of the battery, to determine the brightness limit value in inverse proportion to the output value of the backlight, and to determine the pixel brightness correction value in proportion to the brightness limit value.

3. The display apparatus as claimed in claim 1, further comprising:

a storage unit configured to store a brightness upper limit value and the output value of the backlight in accordance with the remaining amount of the battery, wherein the operation unit is configured to calculate the brightness upper limit value and the output value of the backlight by reading a lookup table stored in the storage unit.

4. A display control method for saving power by a display apparatus, comprising the steps of:

(A) measuring a remaining amount of a battery;

(B) calculating an output value of a backlight using the remaining amount of the battery;

(C) calculating a pixel brightness limit value using the remaining amount of the battery;

(D) calculating a pixel brightness correction value using the pixel brightness limit value (E) changing a display setting using the calculated output value of the backlight and the calculated pixel brightness correction value, thereby displaying an image, wherein the pixel brightness limit value is expressed by:

$$BR_{lim}=I_1*[(BA_{max}-BA_{min})/(BA_{rem}-BA_{min})]*(BR_{max}-BR_{limmax})+J_1*BR_{min}+K_1$$

where $BR_{lim}$ is the brightness limit value, $BA_{rem}$ is the remaining amount of the battery, $BA_{min}$ is the minimum capacity of the battery, $BA_{max}$ is the maximum capacity of the battery, $BR_{max}$ is a maximum brightness value, $BR_{limmax}$ is a maximum brightness limit value, $BR_{min}$ is a minimum brightness value, and $I_1$, $J_1$, and $K_1$ are non-zero correction coefficients.

5. The method as claimed in claim 4, wherein steps (A) to (E) are performed only when the remaining amount of the battery is below a predetermined value.

6. The method as claimed in claim 4, wherein in steps (B) and (C), the output value of the backlight and the pixel brightness limit value are read and calculated from a lookup table.

7. The method as claimed in claim 4, wherein in step (D), the pixel brightness correction value is read and calculated from a lookup table.

8. The method as claimed in claim 4, wherein the output value of the backlight is expressed by:

$$OP_{out}=I_2*[(BA_{rem}-BA_{min})/(BA_{max}-BA_{min})]*(OP_{max}-OP_{min})+J_2*OP_{min}+K_2,$$

where $OP_{out}$ is the output value of the backlight, $BA_{rem}$ is the remaining amount of the battery, $BA_{min}$ is a minimum capacity of the battery, $BA_{max}$ is a maximum capacity of the battery, $OP_{max}$ is a maximum output value, $OP_{min}$ is a minimum output value, and $I_2$, $J_2$ and $K_2$ are correction coefficients.

9. The method as claimed in claim 4, wherein the pixel brightness correction value is expressed by:

$$BR_{out}=I_3*[(BR_{max}-BR_{lim})/BR_{max}]*BR_{in}+BR_{lim}+K_3,$$

where $BR_{out}$ is the pixel brightness correction value, $BR_{lim}$ is the brightness limit value, $BR_{max}$ is the maximum brightness value, $BR_{in}$ is an input brightness value, and $I_3$ and $K_3$ are correction coefficients.

* * * * *